US007474177B2

(12) United States Patent
Kwak et al.

(10) Patent No.: US 7,474,177 B2
(45) Date of Patent: Jan. 6, 2009

(54) EFFICIENCY-IMPROVED TUNING ASSEMBLY FOR RADIO FREQUENCY FILTERS AND METHOD FOR FORMING THE SAME

(75) Inventors: Chang-Soo Kwak, Daejon (KR); Dong-Hwan Shin, Daejon (KR); Youn-Sub Noh, Daejon (KR); In-Bok Yom, Daejon (KR); Dong-Pil Chang, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 236 days.

(21) Appl. No.: 11/489,844

(22) Filed: Jul. 20, 2006

(65) Prior Publication Data

US 2007/0057751 A1 Mar. 15, 2007

(30) Foreign Application Priority Data

Nov. 9, 2005 (KR) ..... 10-2005-0107047

(51) Int. Cl.
*H01P 7/06* (2006.01)

(52) U.S. Cl. ..... 333/232; 333/235

(58) Field of Classification Search ..... 333/223–226, 333/231, 232, 235; 441/393–395, 378
See application file for complete search history.

(56) References Cited

U.S. PATENT DOCUMENTS

| | | | | |
|---|---|---|---|---|
| 3,541,479 | A * | 11/1970 | Martucci | 333/232 |
| 3,601,723 | A * | 8/1971 | Johnson | 334/5 |
| 4,728,913 | A * | 3/1988 | Ishikawa et al. | 333/235 |
| 6,384,699 | B1 | 5/2002 | Henningsson et al. | |
| 7,216,566 | B2 * | 5/2007 | Kwak et al. | 81/13 |

FOREIGN PATENT DOCUMENTS

| | | |
|---|---|---|
| JP | 2001-094307 | 4/2001 |

* cited by examiner

*Primary Examiner*—Rexford Barnie
*Assistant Examiner*—Dylan White
(74) *Attorney, Agent, or Firm*—Ladas & Parry LLP

(57) ABSTRACT

A tuning assembly for a radio frequency is disclosed. The tuning assembly includes: a tuning screw grasping unit integrally formed with a main body of the filter, which includes a tuning screw receiving unit and a fastening member for grasping a tuning screw; and a tuning screw inserted into the filter through the tuning screw receiving unit, wherein the filter is finely tuned by inserting the tuning screw into the filter through the tuning screw receiving unit and a female screw unit formed at the filter.

8 Claims, 7 Drawing Sheets

EFFICIENCY-IMPROVED TUNING ASSEMBLY FOR RADIO FREQUENCY FILTERS AND METHOD FOR FORMING THE SAME

FIELD OF THE INVENTION

The present invention relates to a tuning assembly for improving tuning efficiency; and, more particularly, to a tuning assembly for precisely tuning a radio frequency filter by inserting and fastening a tuning screw at a tuning screw fastening unit that is integrally formed at the radio frequency filter to prevent a tuning screw from being deviated from a tuning completion position and for reducing a tuning time by pressing and fixing the tuning screw in a lateral direction of the tuning screw to improve an operation efficiency.

The present invention also relates to a tuning assembly having a simple structure to effectively tune the filter without using a tuning nut, which makes a tuning operation difficult in a small space because the tuning nut requires a nut wrench to approach the tuning nut in a normal direction to the tuning screw axis, unlike a screw driver approaching the tuning screw in a direction of the tuning screw axis.

DESCRIPTION OF RELATED ARTS

A radio frequency filter is generally designed to finely tune an output thereof using a tuning screw and a tuning unit. That is, an electric signal outputted from the filter varies depending on how deep a tuning screw is inserted into the filter. After the filter is tuned to output a desired electric signal by rotating the tuning screw to be inserted into the filter, the tuning screw is fastened to the filter by the tuning nut. In order to prevent the tuning screw from being deviated from a tuning completion position due to vibration, epoxy is applied around the regions where the tuning screw and the tuning nut meet and where the tuning nut and the filter body meet.

FIGS. 1A and 1B show radio frequency filters having a tuning unit in accordance with the related art. FIG. 1A is a partial cross-sectional view of tuning units arranged in a straight line, and FIG. 1B is a perspective view of the tuning units arranged in a circle.

As shown in FIGS. 1A and 1B, each of the tuning units includes a tuning nut 2 and a tuning screw 3. The tuning screw 3 is inserted into the filter or pulled out from the filter by rotating the tuning screw 3. After completion of tuning, the tuning screw 3 is fixed by rotating the tuning nut 2 in a direction that the tuning screw 3 is inserted into the filter.

FIG. 2 is a view for describing a tuning method of a radio frequency filter using a screw driver and a nut wrench in accordance with the related art. A method of tuning the radio frequency filter according to the related art will be described with reference to FIG. 2. At first, a user holds a screw driver 401 with one hand and holds a nut wrench 402*b* with the other hand. Then, the user holds a nut 2 with a nut fastening unit 402*a* of the nut wrench 402. After loosening the tuning nut 2 using the nut wrench 402, the tuning screw 3 is rotated to tune the radio frequency filter. When the desired electrical output is obtained, the user fastens the tuning screw 3 by rotating the tuning nut 2 using the nut wrench 402 with the position of the hand holding the screw driver 401 maintained.

When the user holds the tuning completion position of the tuning screw 3 with one hand and rotates the tuning nut with the other hand using the nut wrench 402 to fasten the tuning screw, the screw driver 401 is often deviated from the tuning completion position. Therefore, it is very difficult to accurately tune the radio frequency filter according to the related art.

If a filter is very small, the tuning screws are arranged at a very small interval. If a filter is a circular shaped filter, tuning screws are arranged along a radial shape. In these cases, it is very difficult to reach the tuning screw and the tuning nut using the screw driver and the nut wrench at the same time, wherein the screw driver approaches the tuning screw in a vertical direction and the nut wrench approaches the tuning nut in a horizontal direction.

FIG. 3 shows a conventional tuning screw disclosed in U.S. Pat. No. 6,384,699B1.

Referring to FIG. 3, the tuning screw 300 is designed to be self-locked after the tuning screw 300 is inserted into the filter at a predetermined distance. In order to be self-locked, the tuning screw 300 includes a slot formed in the line of the axis and expanded screw threads having a diameter slightly greater than other screw threads. Therefore, the tuning screw is squeezed and tightly joined at the female-screw hole after the tuning screw is inserted into the female-screw hole.

That is, the tuning screw 300 disclosed in U.S. Pat. No. 6,384,699B1 includes the screw threads having an expanded diameter slightly greater than a nominal screw thread and the slot 303 formed in the line of the axis. If the expanded screw threads are pressurized, the expanded screw threads are squeezed into the slot 303.

However, the force that the tuning screw 300 exerts can cause the filter to deform. And the tuning screw 300 may loss the self-locking force after the screw thread 302 is worn away by repeatedly tuning the filter. In this case, the characteristics of the filter may be modified. Also, an additional turning process is required to form the slot 303 in the tuning screw. Therefore, the additional turning process increases the manufacturing cost thereof.

SUMMARY OF THE INVENTION

It is, therefore, an object of the present invention to provide a tuning assembly for improving the efficiency of a tuning operation by forming a tuning screw grasping unit at a filter and grasping the tuning screw in the lateral direction of the tuning screw in order to prevent a tuning screw's deviation from the tuned position that occurs when the tuning screw is fixed by rotating the tuning nut.

In accordance with an aspect of the present invention, there is provided a tuning assembly for a radio frequency filter including: a tuning screw fastening unit integrally formed with a main body of the filter, which includes a tuning screw receiving unit and a fastening member for fastening a tuning screw; and a tuning screw inserted into the filter through the tuning screw receiving unit, wherein the filter is finely tuned by inserting the tuning screw into the filter through the tuning screw receiving unit and a female screw unit formed at the filter.

In accordance with an aspect of the present invention, there is also provided a method of forming a tuning assembly for a radio frequency filter including the steps of: forming a tuning screw female unit at a predetermined position of the filter; forming a tuning screw receiving unit as the upper portion of the tuning screw female unit; forming tuning screw grasping arms to be extended from both sides of the tuning screw receiving unit symmetrically and deformably and to have a through-hole and a bolt female unit alternatively and selectively; inserting a tuning screw into the filter through the tuning screw receiving unit and the tuning screw female unit; and inserting the tuning screw grasping bolt into the bolt female unit through the through-hole of the tuning screw grasping arms and grasping the inserted tuning screw by tightening the tuning screw grasping bolt in a lateral direction of the filter.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a tuning assembly for a radio frequency filter in accordance with a preferred embodiment of the present invention will be described in more detail with reference to the accompanying drawings.

Figure 1A:
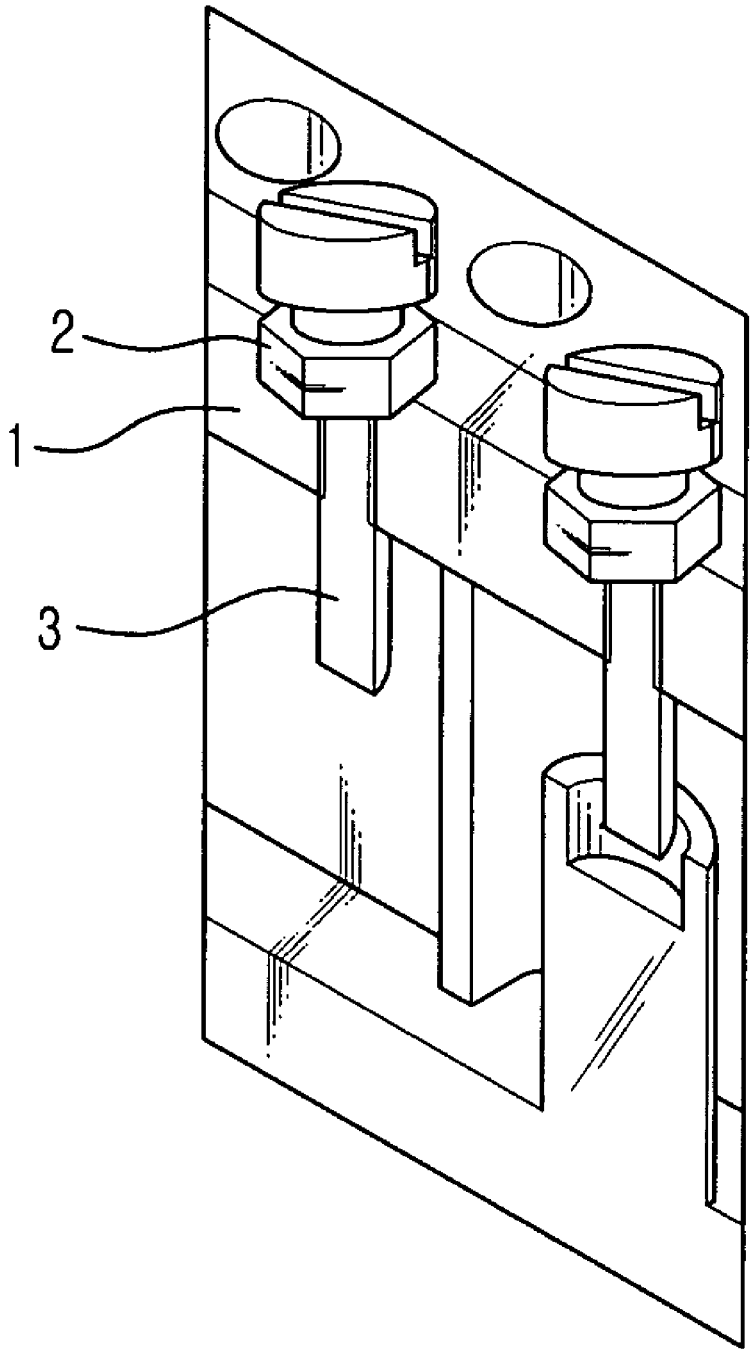
FIG. 1A (PRIOR ART)
FIGS. 1A and 1B show radio frequency filters having a tuning unit in accordance with the related art.
Figure 1B:
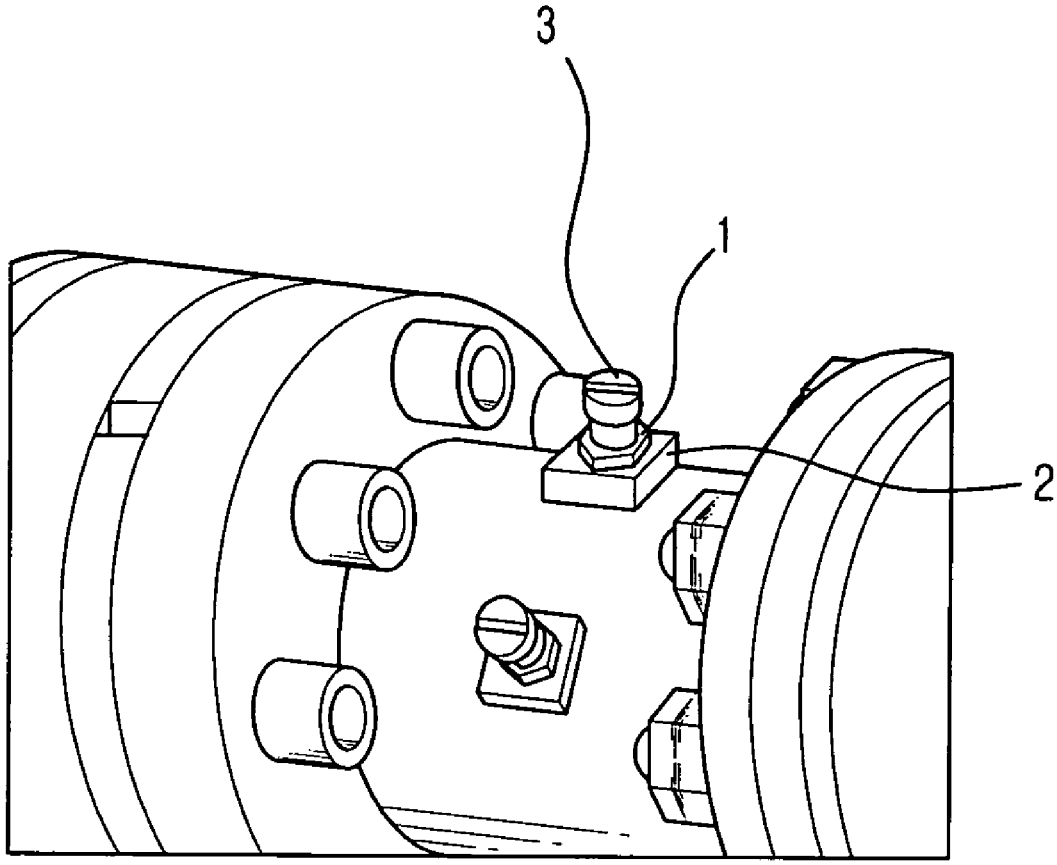
FIG. 1B (PRIOR ART)
Figure 2:
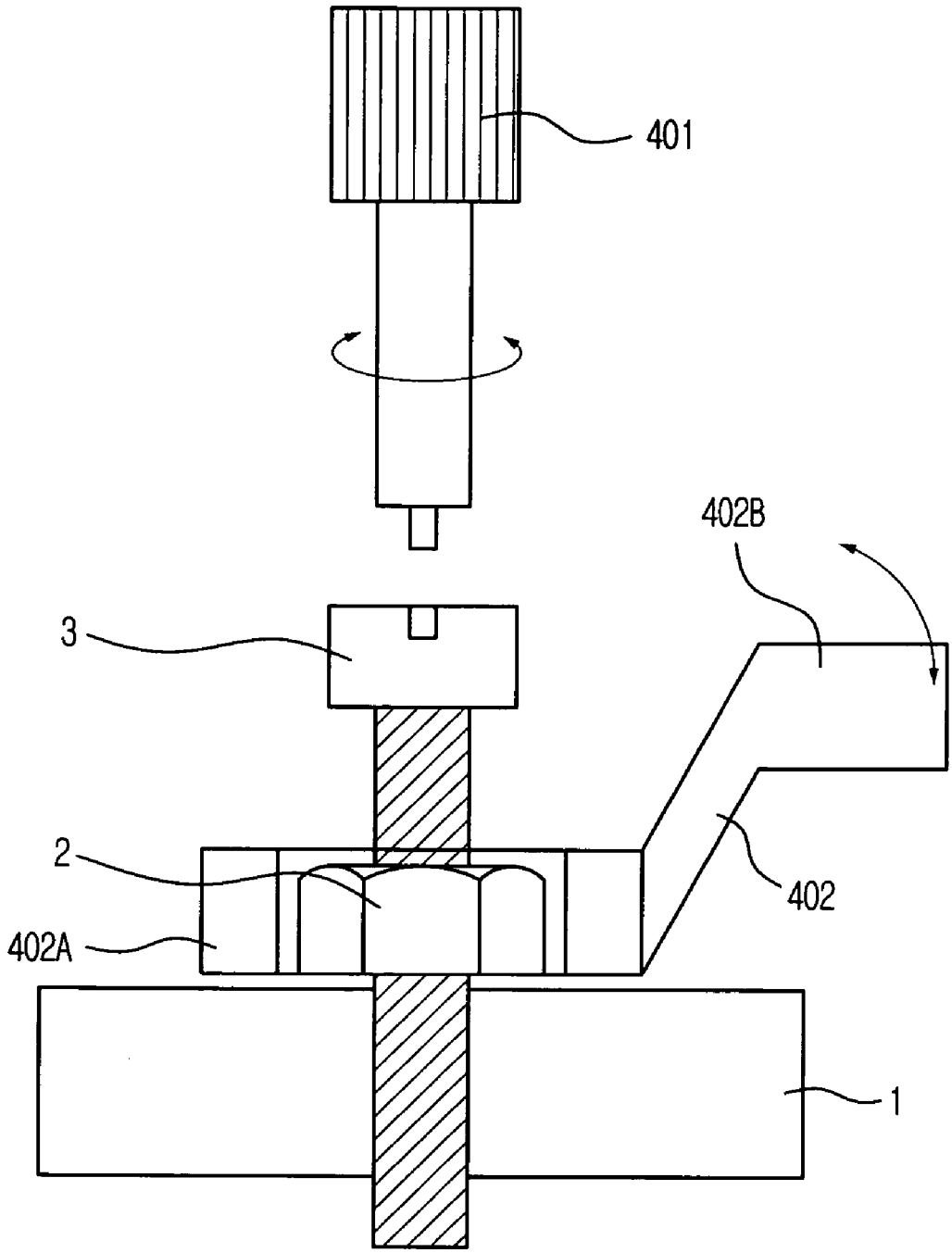
FIG. 2 (PRIOR ART)
FIG. 2 is a view for describing a tuning method of a radio frequency filter using a screw driver and a nut wrench in accordance with the related art.
Figure 3:
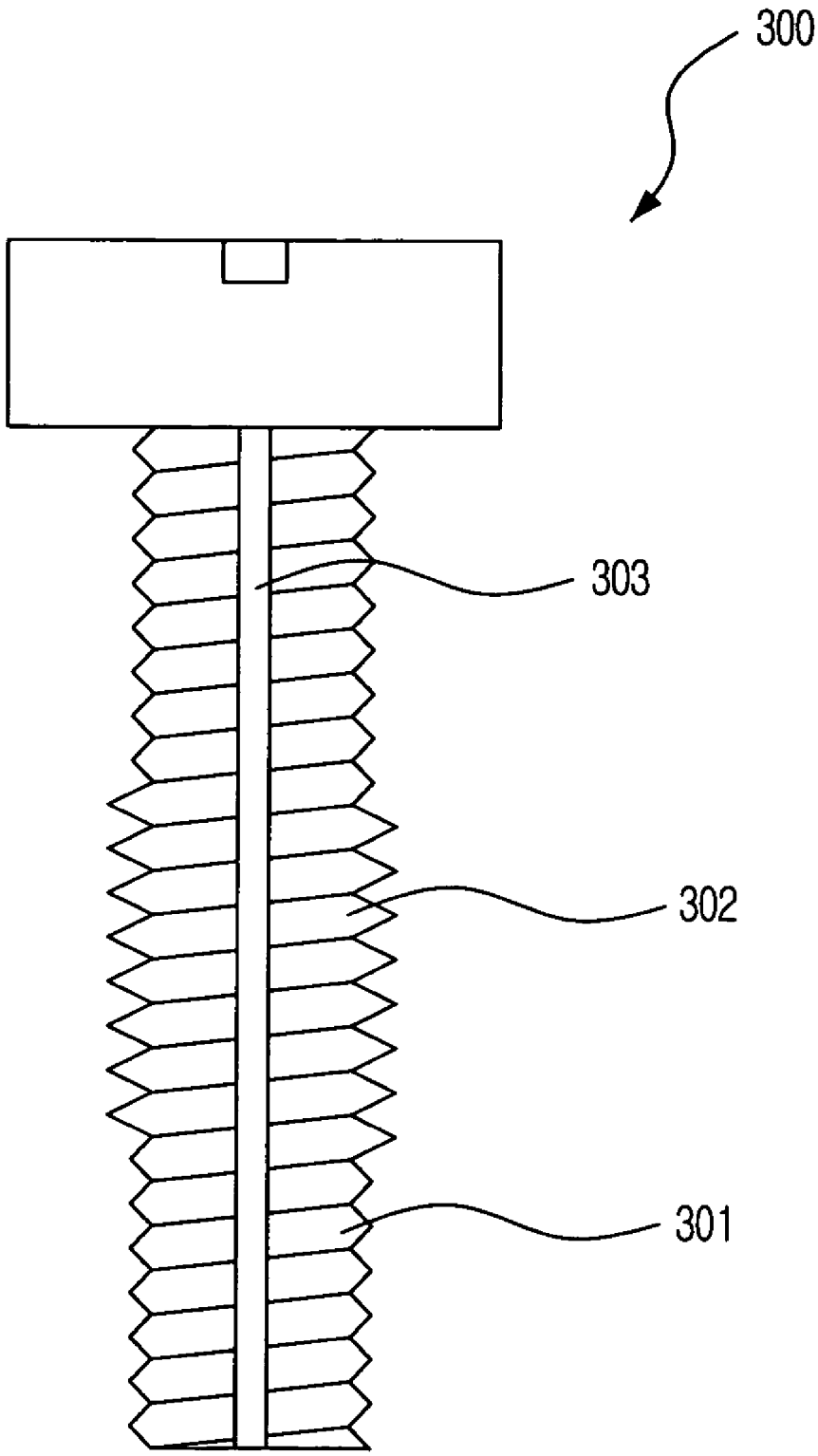
FIG. 3 (PRIOR ART)
FIG. 3 shows a self-locking tuning screw having a part of screw threads having a diameter slightly greater than the other screw threads and a slot formed in a line of axis in accordance with the related art.
Figure 4:
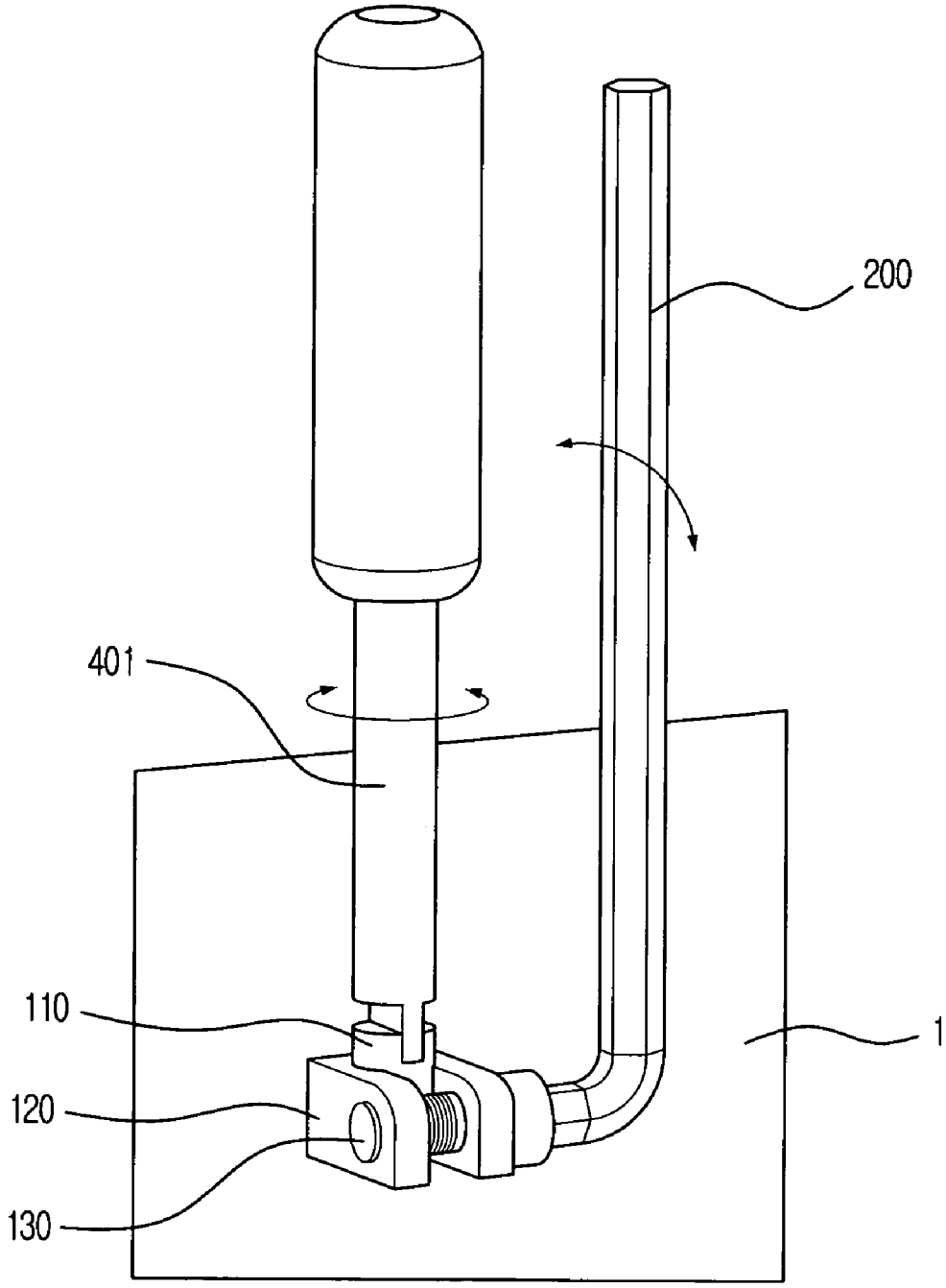
FIG. 4 is a perspective view illustrating a tuning assembly for a radio frequency filter in accordance with a preferred embodiment of the present invention.

FIG. 4 is a perspective view illustrating a tuning assembly for a radio frequency filter in accordance with a preferred embodiment of the present invention.

Figure 6:
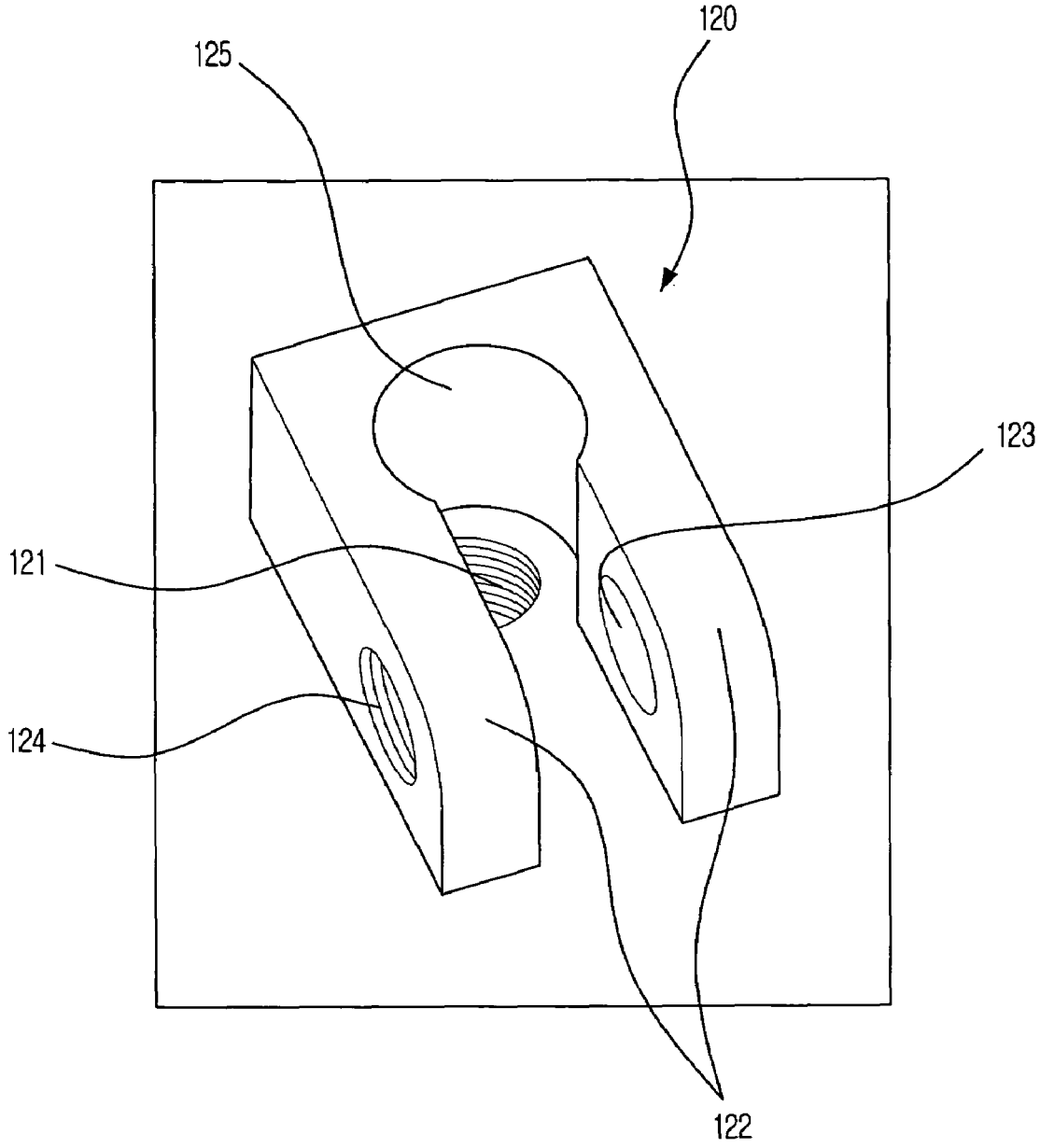
FIG. 6 is a perspective view showing a tuning screw grasping unit in a tuning assembly for a radio frequency filter in accordance with a preferred embodiment of the present invention.

Referring to FIG. 4, the tuning assembly for the radio frequency filter according to the present embodiment includes a tuning screw grasping unit and a tuning screw. The tuning screw grasping unit is integrally formed with the main body of the radio frequency filter. As shown in FIG. 6, the tuning screw fastening unit includes a tuning screw receiving unit 125 and a tuning screw grasping member. The tuning screw receiving unit 125 is formed as an upper portion of a female screw unit 121 formed at the filter. The tuning screw fastening unit further includes tuning screw grasping arms 122 and a tuning screw grasping bolt 130.

The tuning screw grasping arms 122 are formed for grasping the tuning screw. The tuning screw grasping arms 122 are symmetrically and deformably extended from both sides of the tuning screw receiving unit 125. The tuning screw grasping arms 122 include a through hole 123 and a female screw unit 124. The tuning screw grasping bolt 130 is inserted and jointed to the female screw unit 124 through the through-hole 123. The tuning screw grasping unit will be described with reference to FIG. 6.

After loosening the tuning screw grasping unit 120 by rotating the tuning screw grasping bolt 130 to allow a stepped tuning screw 110 to be rotated, the filter is tuned by rotating the stepped tuning screw 110. After completely tuning the filter, the stepped tuning screw 110 is firmly fastening by narrowing a gap between the tuning screw grasping arms 122 using a wrench 200 for fastening a tuning screw grasping bolt 130.

Figure 5:
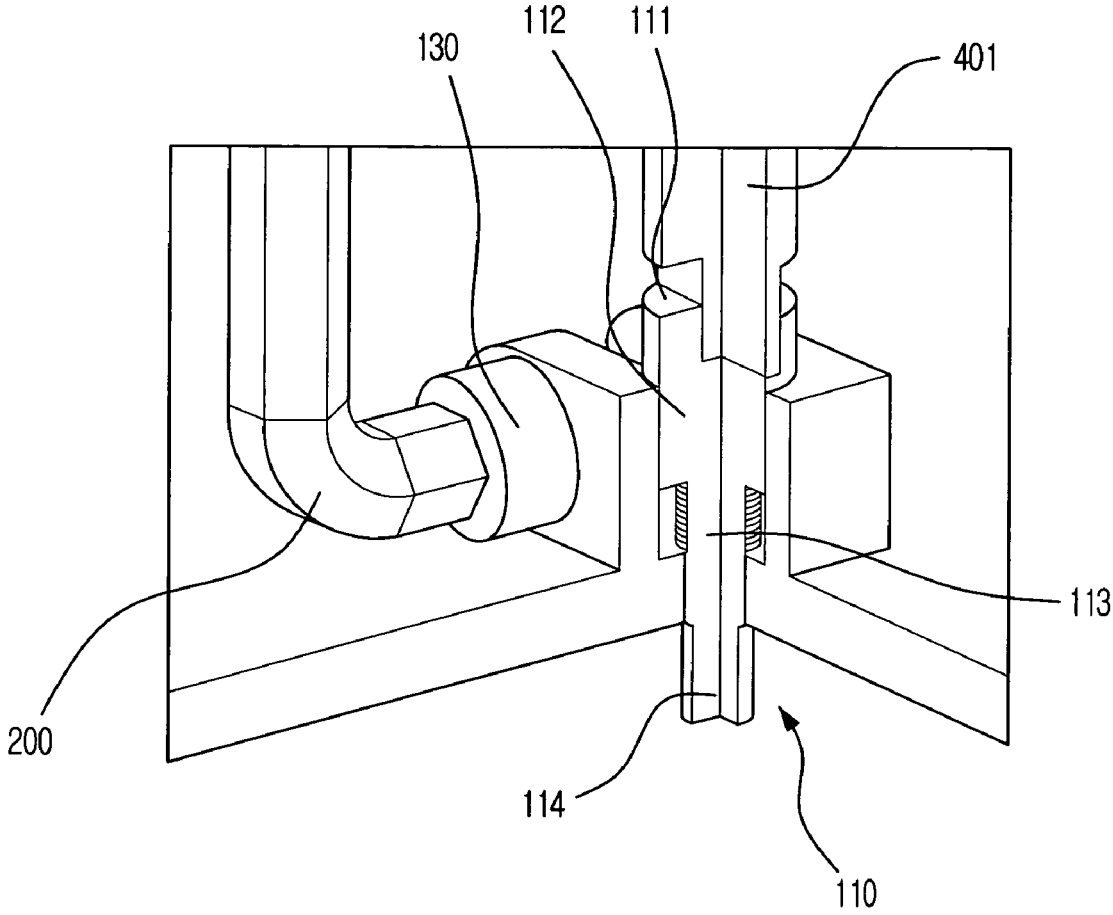
FIG. 5 is a cutout view illustrating a stepped tuning screw for a tuning assembly in accordance with a preferred embodiment of the present invention.

FIG. 5 is a cutout view illustrating a stepped tuning screw for a tuning assembly in accordance with a preferred embodiment of the present invention.

As shown in FIG. 5, the stepped tuning screw 110 includes a bolt head 111, a circular body 112, a screw thread unit 113 and an insertion unit 114.

The bolt head 111 is formed for receiving the screw driver 401. It is preferable to form the bolt head 111 to have a same diameter compared to the circular body 112 in order to minimize the volume of the stepped tuning screw 110. The circular body 112 is firmly held by the tuning screw grasping arms 122. Therefore, it is preferable to form the circular body 112 to have a same size and a same shape compared to the tuning screw receiving unit 125.

Screw threads are formed on the screw thread unit 113. On the contrary, the screw threads are not formed on the insertion unit 114 which is a portion to be inserted into the filter. Also, the circular body 112 is additionally formed to prevent the screw threads from being damaged when the tuning screw is grasped by the tuning screw grasping arms 122. If the screw thread unit 113 is extendedly formed from the end of the tuning screw to the bolt head 111 without the circular body 112, the screw thread may be damaged when the tuning screw 110 is pressed by narrowing the gap between the tuning screw grasping arms 122.

The diameter of the screw thread unit 113 must be carefully decided. If the screw thread unit 113 is formed to have a large diameter, a large hole must be formed at the filter corresponding to the screw thread unit 113. Such a large hole formed at the filter badly influences electric characteristics of the filter. In order not to form the large hole at the filter, the tuning screw 110 according to the present embodiment is formed to have a step difference by forming the screw thread unit 113 to have a smaller diameter and forming the circular body 112 to have a larger diameter. The bolt head 111 may be formed to have a same diameter to the diameter of the circular body 112 to minimize the volume thereof. As described above, the insertion unit 114 not having the screw thread is formed at the end portion of the screw thread unit 113. The insertion unit 114 is inserted into the filter to tune electric characteristics of the filter.

FIG. 6 is a perspective view showing a tuning screw grasping unit in a tuning assembly for a radio frequency filter in accordance with a preferred embodiment of the present invention.

As shown in FIG. 6, the tuning screw grasping unit 120 is integrally formed with the filter. That is, the tuning screw grasping unit 120 is not an assembled part. The tuning screw grasping unit 120 includes a tuning screw receiving unit 125 and a tuning screw grasping member. The tuning screw grasping member includes two tuning screw grasping arms 122 extended from both sides of the tuning screw receiving unit 125 symmetrically and deformably. At one of the two tuning screw fastening arms 122, a through hole 123 is formed to pass the tuning screw fastening bolt 130. At the other, a nut female hole 124 is formed to receive the tuning screw fastening bolt 130. Furthermore, it is preferable to form the tuning screw receiving unit 125 to have a circular shape corresponding to the size of the stepped tuning screw 110 in order to tightly contact the circular body 112 of the stepped tuning screw 110.

The screw thread unit 114 of the stepped tuning screw 110 is inserted into the screw female hole 121. The insertion depth of the stepped tuning screw 110 may vary according to the rotation of the tuning screw.

After obtaining a desired electric characteristic of the filter by inserting the stepped tuning screw 110 into the filter, the stepped tuning screw 110 is grasped by approaching the tuning screw fastening unit 120 from the lateral side of the tuning screw. The structure of the tuning assembly according to the present embodiment allows the tuning screw to be adjusted or to be fastened by approaching the tuning screw fastening unit 120 in the lateral direction of the tuning screw. Therefore, the tuning assembly for the radio frequency filter according to the present embodiment has an enhanced structure for improving the efficiency of the tuning operation.

Hereinafter, a method of forming a tuning assembly of a radio frequency filter in accordance with a preferred embodiment of the present invention will be described. At first, the female screw unit 121 is formed at a predetermined position of a filter. Then, the tuning screw receiving unit 125 is formed as the upper portion of the female screw unit 121. The tuning screw grasping arms 122 are formed to be extended from the both sides of the tuning screw receiving unit 125 symmetrically and deformably. The through-hole 123 and the female screw unit 124 are alternatively and selectively formed on the two tuning screw fastening arms 122. Then, the stepped tuning screw 110 is inserted into the female screw unit 121 of the filter though the tuning receiving unit 125, and the tuning screw grasping bolt 130 is inserted and joined at the nut female hole 124 through the through-hole 123 of the tuning screw grasping arms 122. After inserting, the tuning screw fastening bolt 130 is tightened in the lateral direction of the tuning screw for fastening the stepped tuning screw 110.

As described above, the tuning assembly for the radio frequency filter according to the present invention allows a user to tune the filter by tightening the tuning screw in the lateral direction without using a tuning nut. Therefore, the tuning efficiency is improved by preventing the tuning screw from being rotated unwantedly when the tuning nut is rotated. The tuning assembly according to the present invention allows the screw driver and the wrench to approach the tuning-screw and the tuning screw fastening bolt in the same direction. Therefore, a tuning operation may be easily performed even in a small space.

The present application contains subject matter related to Korean patent application No. KR 2005-0107047, filed in the Korean patent office on Nov. 9, 2005, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A tuning assembly for a radio frequency filter comprising:

a tuning screw fastening unit integrally formed with a main body of the filter, which includes a tuning screw receiving unit and the tuning screw grasping unit; and a tuning screw inserted into the filter through the tuning screw receiving unit, wherein the filter is finely tuned by inserting the tuning screw into the filter through the tuning screw receiving unit and a female screw unit formed at the filter, wherein the grasping member comprises:

tuning screw grasping arms symmetrically and deformably extended from both sides of the tuning screw receiving unit and having a through-hole and a female screw unit selectively and alternatively a tuning screw grasping bolt inserted and joined to the female screw unit through the through-hole of the tuning screw grasping arms.

2. The tuning assembly as recited in claim 1, wherein the tuning screw grasping bolt is tightened by reaching the tuning screw grasping bolt in an orthogonal direction to an insertion direction of the tuning screw.

3. The tuning assembly as recited in claim 1, wherein the tuning screw is a stepped tuning screw having a bolt head, a circular body and a screw thread unit.

4. The tuning assembly as recited in claim 3, wherein the stepped tuning screw further includes an insertion unit at the end of the screw unit.

5. A method of forming a tuning assembly for a radio frequency filter comprising the steps of:

forming a tuning screw female unit at a predetermined position of the filter;

forming a tuning screw receiving unit as the upper portion of the tuning screw female unit;

forming tuning screw grasping arms to be extended from both sides of the tuning screw receiving unit symmetrically and deformably and to have a through-hole and a bolt female unit alternatively and selectively;

inserting a tuning screw to the filter through the tuning screw receiving unit and the tuning screw female unit;

Inserting the tuning screw grasping bolt into the bolt female unit through the through-hole of the tuning screw grasping arms and fastening the inserted tuning screw by tightening the tuning screw grasping bolt in a lateral direction of the tuning screw.

6. The tuning assembly as recited in claim 3, wherein the bolt head has the same diameter as the circular body.

7. The tuning assembly as recited in claim 3, wherein the circular body has the same size and shape as the tuning screw receiving unit.

8. The tuning assembly as recited in claim 3, wherein the diameter of the screw thread unit is smaller than the diameter of the circular body.

* * * * *